US007383921B2

(12) United States Patent
Higashi

(10) Patent No.: US 7,383,921 B2
(45) Date of Patent: Jun. 10, 2008

(54) ELEVATOR WITH A SUPPORT FOR A HOISTING MACHINE

(75) Inventor: Masayuki Higashi, Fuchu (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 443 days.

(21) Appl. No.: 10/529,863

(22) PCT Filed: Oct. 16, 2003

(86) PCT No.: PCT/JP03/13245

§ 371 (c)(1),
(2), (4) Date: Apr. 1, 2005

(87) PCT Pub. No.: WO2004/037701

PCT Pub. Date: May 6, 2004

(65) Prior Publication Data

US 2005/0269162 A1 Dec. 8, 2005

(30) Foreign Application Priority Data

Oct. 28, 2002 (JP) ..... 2002-312666

(51) Int. Cl.
*B66B 11/08* (2006.01)

(52) U.S. Cl. ..... 187/254; 187/256

(58) Field of Classification Search ..... 187/254, 187/255, 256, 258, 266, 277, 391, 411, 413
See application file for complete search history.

(56) References Cited

U.S. PATENT DOCUMENTS

| | | | | |
|---|---|---|---|---|
| 5,469,937 | A * | 11/1995 | Hakala et al. | 187/266 |
| 6,230,844 | B1 | 5/2001 | Latorre | |
| 6,247,557 | B1 * | 6/2001 | Kobayashi et al. | 187/266 |
| 6,488,124 | B1 * | 12/2002 | Yasuda et al. | 187/254 |
| 6,598,707 | B2 * | 7/2003 | Nakagaki et al. | 187/256 |
| 6,691,833 | B1 | 2/2004 | Elsener et al. | |
| 2004/0108170 | A1 * | 6/2004 | Kocher et al. | 187/254 |

FOREIGN PATENT DOCUMENTS

| | | |
|---|---|---|
| DE | 298 06 526 U 1 | 9/1998 |
| DE | 199 31 396 A 1 | 1/2000 |
| EP | 1 053 969 A2 | 11/2000 |
| EP | 1 057 771 A2 | 12/2000 |
| EP | 1 302 430 A1 | 4/2003 |
| EP | 1 327 596 A1 | 7/2003 |
| EP | 1 447 370 A1 | 8/2004 |
| JP | 11-139730 | 5/1999 |
| JP | 2000-7253 | 1/2000 |
| JP | 2000-153973 | 6/2000 |
| JP | 2001-171953 | 6/2001 |

(Continued)

*Primary Examiner*—Jonathan Salata
(74) *Attorney, Agent, or Firm*—Oblon, Spivak, McClelland, Maier & Neustadt, P.C.

(57) ABSTRACT

An elevator including a car placed in an elevator shaft so as to move vertically along a pair of car guide rails, and a counterweight placed in the elevator shaft so as to move vertically along a pair of counterweight guide rails. A rope connects the car and the counterweight. A hoisting machine drives the rope. The hoisting machine is mounted on a base attached to the upper ends of the counterweight guide rails and the upper end of one of the pair of car guide rails.

12 Claims, 5 Drawing Sheets

FOREIGN PATENT DOCUMENTS

| | | |
|---|---|---|
| JP | 2002-179355 | 6/2002 |
| KR | 2001-0085674 | 9/2001 |
| KR | 2002-0021160 | 3/2002 |
| KR | 10-2004-0042996 | 5/2004 |
| WO | 01/89975 | 11/2001 |
| WO | 02/18256 | 3/2002 |

* cited by examiner

ELEVATOR WITH A SUPPORT FOR A HOISTING MACHINE

TECHNICAL FIELD

The present invention relates to a traction-type elevator having a car, a counterweight, and a hoisting machine for driving a rope connecting the car and the counterweight, and not needing any elevator machinery room.

BACKGROUND ART

Referring to FIG. 5, a prior art traction-type elevator has a car 3 that moves vertically by a pair of car guide rails 2*a* and 2*b*, and a counterweight 10 that moves vertically along a pair of counterweight guide rails 1*a* and 1*b*. A rope 6*a* connecting the car 3 and the counterweight 10 is driven by a hoisting machine 5. When the hoisting machine 5 is installed in an upper part of an elevator shaft 15, the hoisting machine 5 is supported on the pair of counterweight guide rails 1*a* and 1*b* in a space between the car 3 and a side wall of the elevator shaft 15. (Jpn. Pat. App. Hei 7-308515).

In this prior art elevator, the center of gravity of the car 3 that moves vertically along the pair of car guide rails 2*a* and 2*b* is apart from the center of the pair of counterweight guide rails 1*a* and 1*b* and hence a high force acts on the hoisting machine 5. Therefore, a high bending force act on the pair of counterweight guide rails 1*a* and 1*b*.

DISCLOSURE OF THE INVENTION

The present invention has been made in view of such circumstances and it is therefore an object of the present invention to provide an elevator including a pair of counterweight guide rails, and a hoisting machine supported on the pair of counterweight guide rails, and capable of limiting a bending force that acts on the counterweight guide rails to a low level.

According to the present invention, an elevator comprises: a car placed in a elevator shaft so as to move vertically along a pair of car guide rails; a counterweight placed in the elevator shaft so as to move vertically along a pair of counterweight guide rails, and connected to the car by a rope; and a hoisting machine for driving the rope; wherein the hoisting machine is mounted on a base attached to the upper ends of the pair of counterweight guide rails and the upper end of one of the pair of car guide rails, and the hoisting machine overlaps the car in a projection on a horizontal plane.

In the elevator according to the present invention, the rope has one end attached to a rope-suspending member, and the rope-suspending member is mounted on the base.

In the elevator according to the present invention, the base is mounted on the upper ends of the pair of counterweight guide rails and the upper end of one of the pair of car guide rails through rubber vibration isolators held between the base and the upper ends of the pair of counterweight guide rails and one of the car guide rails.

In the elevator according to the present invention, the hoisting machine and the car overlap each other.

In the elevator according to the present invention, a straight line extending between the pair of counterweight guide rails, and a straight line extending between the pair of car guide rails are perpendicular to each other.

In the elevator according to the present invention, the base has three parts respectively mounted on the upper ends of the pair of counterweight guide rails and the upper end of one of the pair of car guide rails.

In the elevator according to the present invention, the base is mounted on the upper ends of the counterweight guide rails and the upper end of one of the pair of car guide rails through length-adjustable shims held between the base and the upper ends of the pair of counterweight guide rails and one of the pair of car guide rails.

In the elevator according to the present invention, the rubber vibration isolators are provided with bolt holes, respectively.

In the elevator according to the present invention, the base has a rectangular shape, the hoisting machine is disposed on a part near one end of the base, and the rope-suspending member is disposed on a part near the other end of the base.

In the elevator according to the present invention, the center of gravity of the hoisting machine is near one of the guide rails.

BEST MODE FOR CARRYING OUT THE INVENTION

A preferred embodiment of the present invention will be described with reference to the accompanying drawings. FIGS. 1 to 4(*a*) (*b*) show an elevator in a preferred embodiment according to the present invention.

Referring to FIGS. 1 to 4(*a*)(*b*), an elevator has a car 3 placed in an elevator shaft 15 so as to move vertically along a pair of car guide rails 2*a* and 2*b*, and a counterweight 10 placed in the elevator shaft 15 so as to move vertically along a pair of counterweight guide rails 1*a* and 1*b*. The car 3 and the counterweight 10 are connected by a rope 6*a* wound around a sheave 5*a* mounted on the output shaft of a hoisting machine 5. The hoisting machine 5 drives the rope 6*a* through the sheave 5*a*.

Figure 1:
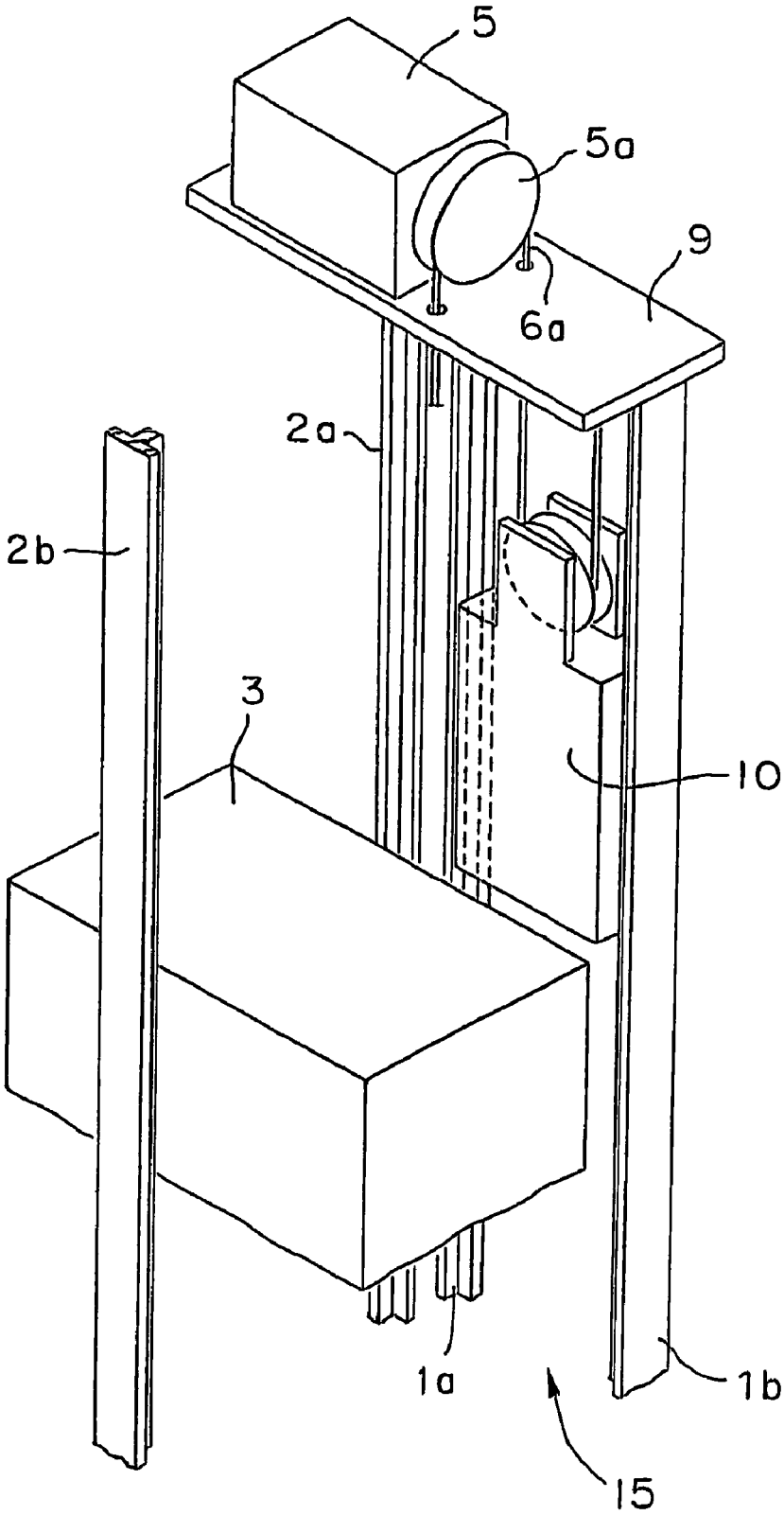
FIG. 1 is a perspective view of an elevator in a preferred embodiment according to the present invention.
Figure 2:
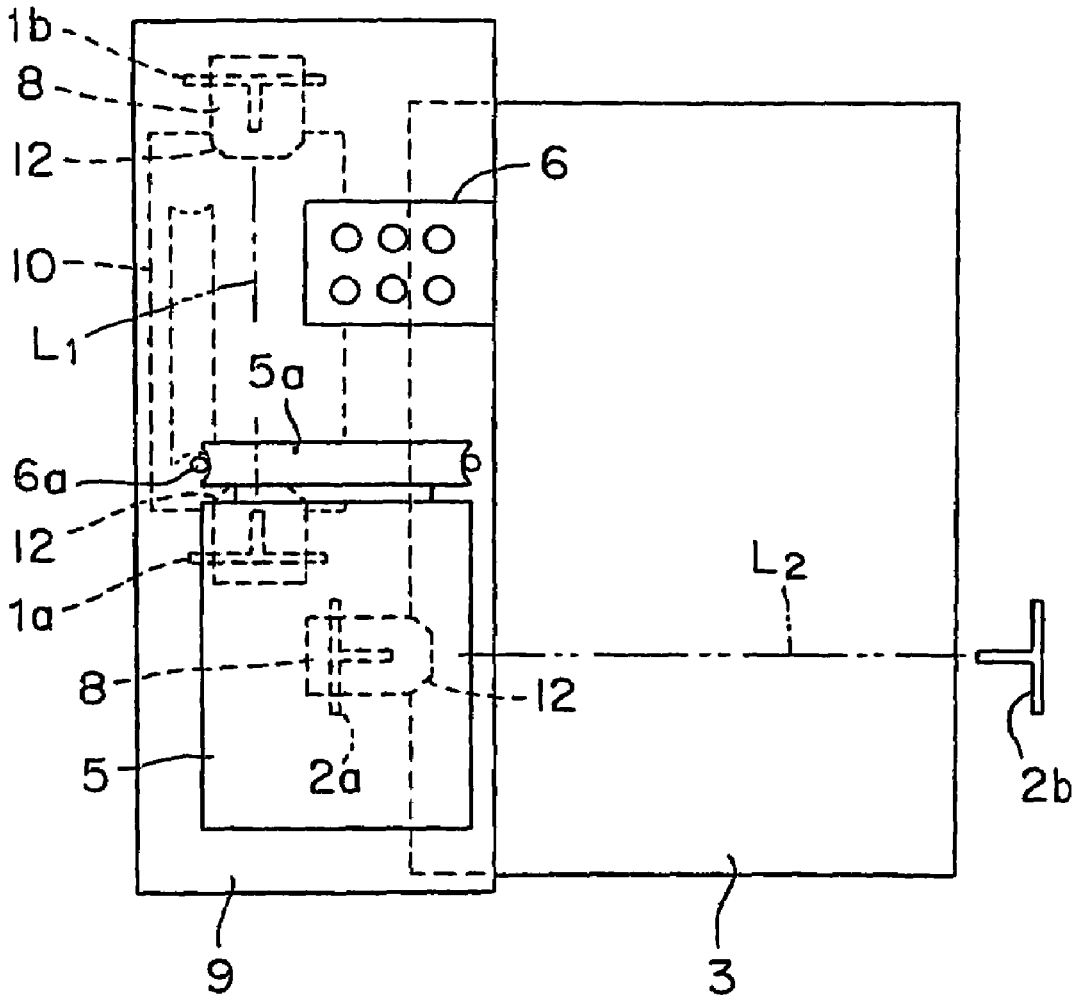
FIG. 2 is a plan view of the elevator.

As shown in FIG. 2, the pair of counterweight guide rails 1*a* and 1*b*, and the pair of car guide rails 2*a* and 2*b* are disposed so that a straight line $L_2$ extending between the car guide rails 2*a* and 2*b*, and a straight line $L_1$ extending between the counterweight guide rails 1*a* and 1*b* are perpendicular to each other.

The hoisting machine 5 is mounted on a rectangular base 9. The base 9 is mounted on the upper ends of the pair of counterweight guide rails 1*a* and 1*b*, and the upper end of the car guide rail 2*a*, i.e., one of the car guide rails 2*a* and 2*b*.

The rope 6*a* has one end attached to a rope-suspending member 6 mounted on the base, and the other end attached to a rope-suspending member attached to an upper part of the car guide rail 2*b*.

Figure 3:
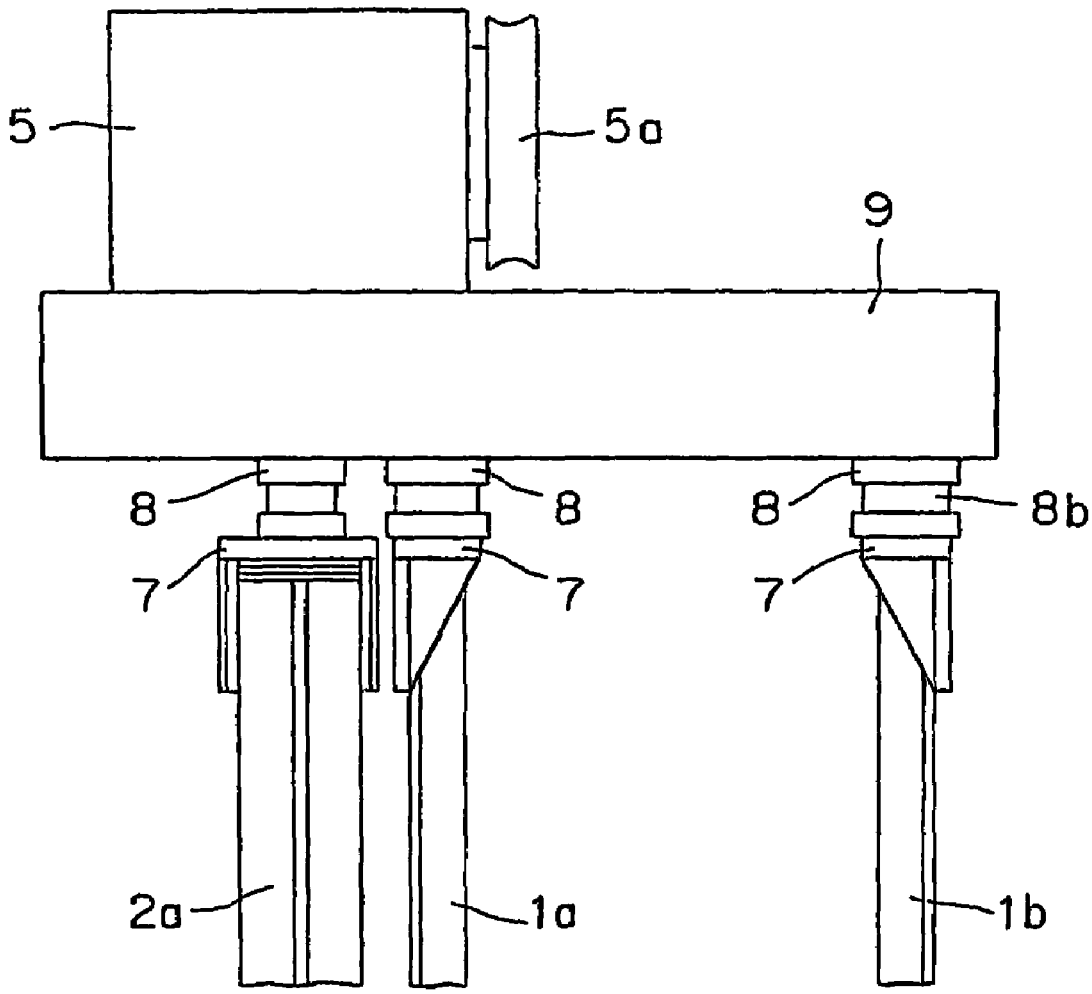
FIG. 3 is an enlarged view of a base support structure.
Figure 4:
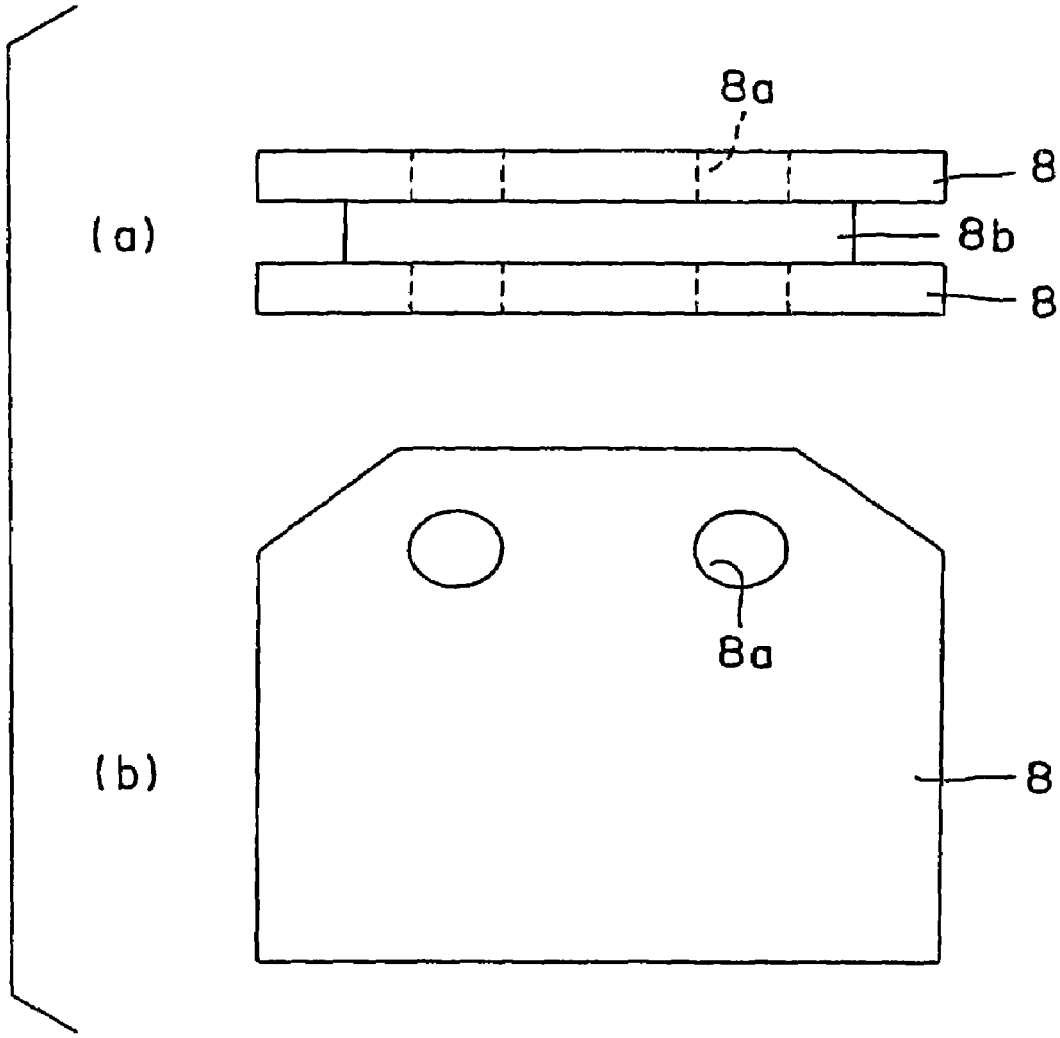
FIGS. 4(*a*) and 4(*b*) are views of a shim and rubber vibration isolators.
Figure 5:
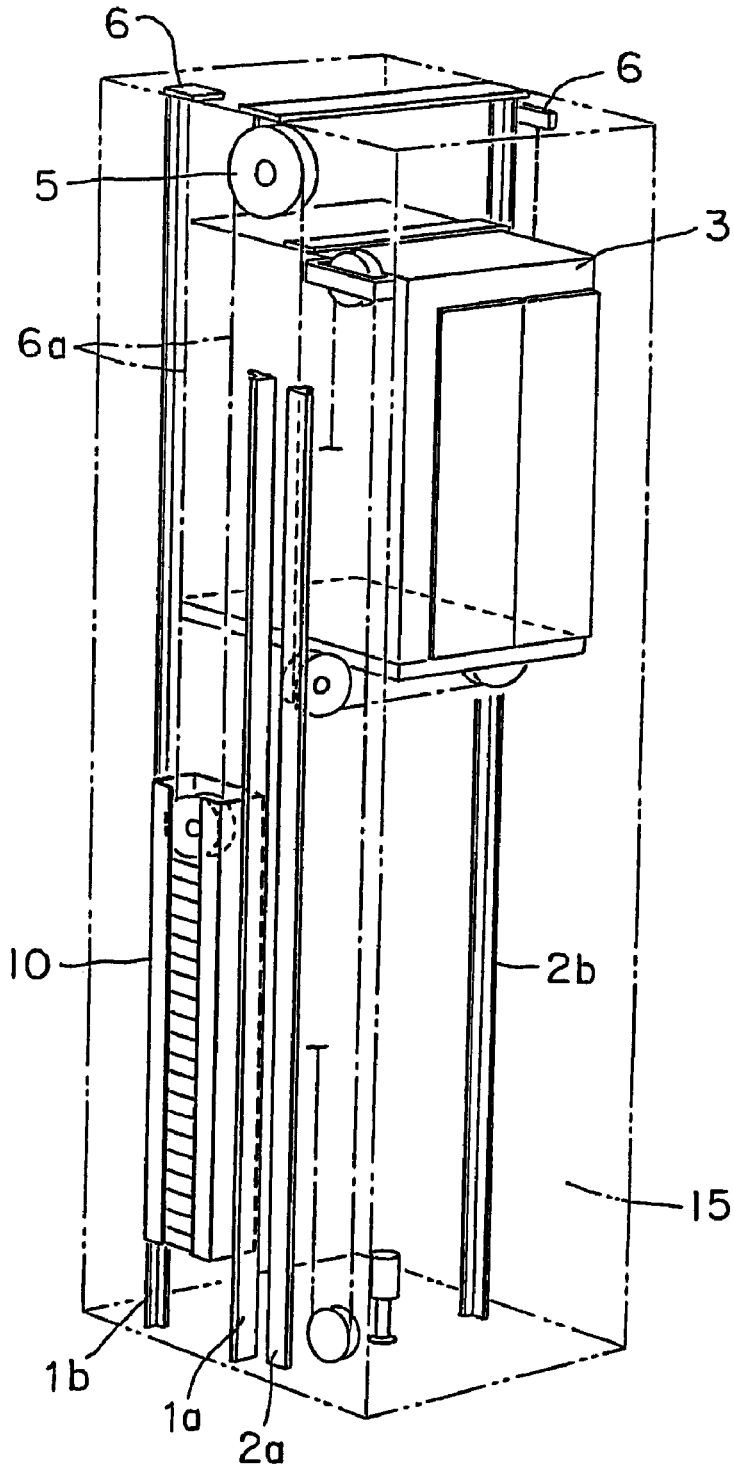
FIG. 5 PRIOR ART
FIG. 5 is a perspective view of a prior art elevator.

A support structure for supporting the base 9 will be described with reference to FIGS. 3 and 4. Referring to FIGS. 3 and 4, brackets 7 are attached to the upper ends of the pair of counterweight guide rails 1*a* and 1*b*, and the upper end of the car guide rail 2*a*. The base 9 is mounted on the counterweight guide rails 1*a* and 1*b*, and the car guide rail 2*a*. A pair of rubber vibration isolators 8 and a shim 8*b* are held between the base 9 and each of the brackets 7.

As shown in FIG. 2 in a plan view, the hoisting machine 5 partially overlaps the car 3.

The operation of this embodiment will be described.

The hoisting machine 5 drives the rope 6*a* through the sheave 5*a* to move the car 3 and the counterweight 10 vertically in the elevator shaft 15.

The base 9 supporting the hoisting machine 5 has three parts respectively mounted on the upper ends of the pair of counterweight guide rails 1*a* and 1*b*, and the upper end of the car guide rail 2*a*, i.e., one of the pair of car guide rails 2*a* and 2*b*. Thus, force exerted through the rope 6*a* on the hoisting machine 5 is distributed uniformly to the guide rails 1*a*, 1*b* and 2*a*. Therefore, the pair of counterweight guide rails 1*a* and 1*b* may be of a small size.

Since the car 3 and the hoisting machine 5 partially overlap each other in a projection on a horizontal plane, the car 3 can be moved by the rope 6*a* wound round the sheave 5*a* mounted on the output shaft of the hoisting machine 5 and nearer to the center of gravity of the car 3. Thus, the car 3 can stably be moved by the rope 6*a*.

The base 9 is mounted on the upper ends of the pair of counterweight guide rails 1*a* and 1*b*, and the upper end of the car guide rail 2*a* through the length-adjustable shim 8*b* held between the base 9 and each of the upper ends of the guide rails 1*a*, 1*b* and 2*a*. Therefore, the base 9 can stably and horizontally be set on the guide rails 1*a*, 1*b* and 2*a* even if the guide rails 1*a*, 1*b* and 2*a* have different lengths, respectively. The rubber vibration isolators 8 held between the base 9 and the upper ends of the pair of counterweight guide rails 1*a* and 1*b*, and the upper end of the car guide rail 2*a* isolates the hoisting machine 5 from the vibrations of the guide rails 1*a*, 1*b* and 2*a*.

Since the rubber vibration isolators 8 are provided with bolt holes 8*a* as shown in FIGS. 4(*a*) and 4(*b*), the rubber vibration isolators 8 can easily be attached to the base 9 and the brackets 7 by passing bolts, not shown, through the bolt holes 8*a*.

Since the hoisting machine 5 is disposed on a part near one end of the base, and the rope-suspending member 6 is disposed on a part near the other end of the base, as viewed in a plan view shown in FIG. 2, force is distributed uniformly exerted on the base 9, and hence force can uniformly be exerted on the guide rails 1*a*, 1*b* and 2*a* by the base 9. The center of gravity of the hoisting machine 5 is near the guide rail 2*a*.

As apparent from the foregoing description, according to the present invention, the force produced by the hoisting machine is distributed to the pair of counterweight guide rails and one of the car guide rails. Thus, high bending force does not act only on the pair of counterweight guide rails supporting the hoisting machine because the hoisting machine is attached to the upper parts of the pair of counterweight guide rails, and the upper part of one of the car guide rails. Therefore, the counterweight guide rails do not need to be of a very large shape. Since the hoisting machine and the car partially overlap each other as viewed in a projection on a horizontal plane, the hoisting machine can be disposed near the center of gravity of the car and the hoisting machine can stably drive the car through the rope.

The invention claimed is:

1. An elevator comprising:

a car placed in a elevator shaft so as to move vertically along a pair of car guide rails;

a counterweight placed in the elevator shaft so as to move vertically along a pair of counterweight guide rails, and connected to the car by a rope extending around a sheave of the counterweight with an axis of rotation; and a hoisting machine for driving the rope and including a sheave of the hoisting machine with an axis of rotation;

wherein the hoisting machine is mounted on a base attached to the upper ends of the pair of counterweight guide rails and the upper end of one of the pair of car guide rails;

the hoisting machine overlaps the car in a projection on a horizontal plane;

the base has three parts respectively mounted on the upper ends of the pair of counterweight guide rails and the upper end of one of the pair of car guide rails; and the axis of rotation of the sheave of the hoisting machine is non-parallel relative to the axis of rotation of the sheave of the counterweight.

2. The elevator according to claim 1, wherein the rope has one end attached to a rope-suspending member, and the rope suspending member is mounted on the base.

3. The elevator according to claim 1, wherein the base is mounted on the upper ends of the pair of counterweight guide rails and the upper end of one of the pair of car guide rails through rubber vibration isolators held between the base and the upper ends of the pair of counterweight guide rails and one of the pair of car guide rails.

4. The elevator according to claim 1, wherein the hoisting machine and the car partially overlap each other.

5. The elevator according to claim 1, wherein a straight line extending between the pair of counterweight guide rails, and a straight line extending between the pair of car guide rails are perpendicular to each other.

6. The elevator according to claim 1, wherein the base is mounted on the upper ends of the counterweight guide rails and the upper end of one of the pair of car guide rails through length-adjustable shims held between the base and the upper ends of the pair of counterweight guide rails and one of the pair of car guide rails.

7. The elevator according to claim 3, wherein the rubber vibration isolators are provided with bolt holes, respectively.

8. The elevator according to claim 3, wherein the base has a rectangular shape, the hoisting machine is disposed on a part near one end of the base, and the rope-suspending member is disposed on a part near the other end of the base.

9. The elevator according to claim 1, wherein the center of gravity of the hoisting machine is near one of the guide rails.

10. The elevator device according to claim 1, wherein a straight line extending between the pair of counterweight guide rails and the axis of the hoisting machine are perpendicular to each other.

11. The elevator device according to claim 1, wherein the hoisting machine has a shape extending lengthwise in the direction of its axis.

12. The elevator device according to claim 1, wherein the axis of rotation of the sheave of the hoisting machine is perpendicular to the axis of rotation of the sheave of the counterweight.

* * * * *